US006439193B2

(12) United States Patent
Lehtonen

(10) Patent No.: US 6,439,193 B2
(45) Date of Patent: Aug. 27, 2002

(54) FUEL INJECTION VALVE FOR RECIPROCATING INTERNAL COMBUSTION ENGINE

(75) Inventor: Kai Lehtonen, Vaasa (FI)

(73) Assignee: Wärtsilä Nsd Oy AB, Helsinki (FI)

( * ) Notice: Subject to any disclaimer, the term of this patent is extended or adjusted under 35 U.S.C. 154(b) by 0 days.

(21) Appl. No.: 09/737,424

(22) Filed: Dec. 15, 2000

(30) Foreign Application Priority Data

Dec. 16, 1999 (FI) ..... 19992707

(51) Int. Cl.[7] ..... F02M 37/04
(52) U.S. Cl. ..... 123/299; 123/467
(58) Field of Search ..... 123/446, 447, 123/467, 299–300; 239/585, 533.2

(56) References Cited

U.S. PATENT DOCUMENTS 4,687,136 A 8/1987 Ozu et al.
5,899,389 A * 5/1999 Pataki et al. ..... 239/533.2
6,073,862 A * 6/2000 Touchette et al. ..... 239/408

FOREIGN PATENT DOCUMENTS

DE 30 09 750 9/1981
EP 0 961 024 12/1999

* cited by examiner

*Primary Examiner*—Thomas N. Moulis
(74) *Attorney, Agent, or Firm*—John Smith-Hill; Smith-Hill and Bedell

(57) ABSTRACT

An injection valve arrangement which is to be connected with a common rail of a fuel feeding system of a combustion engine comprises a valve body. A first valve needle and a first piston arrangement functionally coupled thereto and a second valve needle and a second piston arrangement functionally coupled thereto are inside the valve body. The needle valves are arranged operationally in series so that the first needle valve is connected to feed pressure of the common rail and is arranged to open always first. The second needle valve controls the injection of the fuel into a cylinder of the engine.

21 Claims, 6 Drawing Sheets

10
9
13a
15a
20
15b
13b
16a
16b
5a
5b
12a
18b
18a
12b
4a
4b
11a
11b
3a
3b
2a
6
1
6a
2b
7a
8a
8
7b 10
9
13a
15a
20
15b
13b
16a
17a
5a
12a
18a
16b
5b
18b
12b
4a
4b
11a
11b
3a
3b
2a
6
1
6a
2b
7a
8a
8
7b 10
9
13a
15a
20
15b
13b
16a
16b
5a
17b
12a
5b
18a
18b
12b
4a
4b
11a
11b
3a
3b
2a
6
1
6a
2b
7a
8a
8
7b 10
9
13a
15a
20
15b
13b
16a
21b
16b
5a
17b
12a
5b
18a
18b
12b
4a
4b
11a
11b
3a
3b
2a
6
1
6a
2b
7a
8a
8
7b

FUEL INJECTION VALVE FOR RECIPROCATING INTERNAL COMBUSTION ENGINE

BACKGROUND OF THE INVENTION

This invention relates to a fuel injection valve arrangement to be connected with a common rail of a fuel feeding system of a reciprocating internal combustion engine.

So called needle valves, in which the valve member is elongated and quite thin, are commonly used to control fuel injection. Specifically fuel injection arrangements based on a common rail are commonly used and also for example heavy oil may be utilized as fuel. In this kind of known arrangement, injection control is accomplished by a positively controlled needle valve or by a separate control valve positioned before the needle valve and spring loaded needle valve. If a sealing surface of the needle valve in an arrangement based on positive control leaks or the valve needle sticks at its open position, or a sealing surface of a pre-control valve in an arrangement based on a pre-control valve leaks, fuel may leak into the cylinder and serious engine damage may result.

SUMMARY OF THE INVENTION

An object of the invention is to provide an injection valve arrangement to be specifically applicable to a fuel injection arrangement based on a common rail, which is reliable, with which the injection procedure is better controllable and by means of which drawbacks of known arrangements may be substantially eliminated.

According to the invention, the injection valve arrangement comprises a first valve needle and a first piston arrangement connected thereto, and a second valve needle and a second piston arrangement connected thereto. The needle valves are arranged operationally in series so that the first needle valve is connected to feed pressure of the common rail and is arranged to open always first. The second needle valve controls the injection of fuel into a cylinder of the engine. The solution based on two needle valves in series, in which the injection takes place only when both of the valves are simultaneously open, is considerably safer than a construction with one valve, because the possibility of leakage or of both valves sticking at the open position simultaneously is substantially less. The two needle valves operate under different conditions. During opening of the first needle valve, the pressure difference over the first valve needle is very small, because the second needle valve is still closed. During opening of the second needle valve, the conditions correspond to those during opening of the conventional injection valve with one needle in a common rail system.

Preferably, the valve arrangement is controlled so that after the injection the first needle valve also closes last. Thus the second needle valve always controls the injection and there is no flow over the sealing surface of the first needle valve during its closing stage, because the second needle valve has already been closed. In this manner, simultaneous malfunction of the two needle valves due to different operation conditions is rendered even more improbable, which results in accurate control of the injection process and increased safety.

In practice each piston arrangement preferably comprises a main piston device to be connected with a valve needle, and an auxiliary piston connected to the main piston device so that a pressure chamber, which has been connected with control pressure through a constriction channel, is formed therebetween. The auxiliary piston is preferably spring loaded in direction away from the main piston device.

A preferred expedient for causing the first needle valve to open first, is for the main piston device of the first needle valve to be of smaller diameter than the main piston device of the second needle valve.

The constriction channel may advantageously be formed in the auxiliary piston. The auxiliary piston may be influenced by another pressure chamber, into which the constriction channel opens.

The other pressure chamber is connected to control pressure through a constriction channel and it is additionally connectable to control pressure over a separate constriction channel, which the auxiliary piston opens for closing the needle valve. Since the diameter of the constriction channel in connection with piston arrangement of the first needle valve, opened by the auxiliary piston, is preferably smaller than the diameter of the corresponding constriction channel in connection with the piston arrangement of the second needle valve, the first needle valve closes after the second needle valve. Because in this manner the opening and closing of the needle valves are accomplished by substantially different means, they can be effected independently of each other.

The control of the piston arrangements may advantageously be accomplished by means of a hydraulic oil arrangement or the like, which acts on both of the piston arrangements, and by means of a separate control valve, by means of which the pressure chambers influencing the piston arrangements are connectable selectively to substantially lower pressure, preferably to atmospheric pressure. In practice the hydraulic oil arrangement may be for example a part of lubrication system of the engine. Because the pressure of the lubrication oil circuit is typically about 7 bar, a booster pump, by means of which the pressure may be increased to a level of about 200 bar, is thus required.

The pressure chambers influencing the first piston arrangement and the pressure chambers influencing the second piston arrangement are separated from each other and connected to the control valve by separate constriction channels. Since there are two separate constriction channels in the arrangement according to the invention, only one control valve, which is preferably a solenoid valve, is needed.

BRIEF DESCRIPTION OF THE DRAWINGS

In the following the invention is described, by way of example, with reference to the attached drawings, in which.

DETAILED DESCRIPTION

Figure 1:
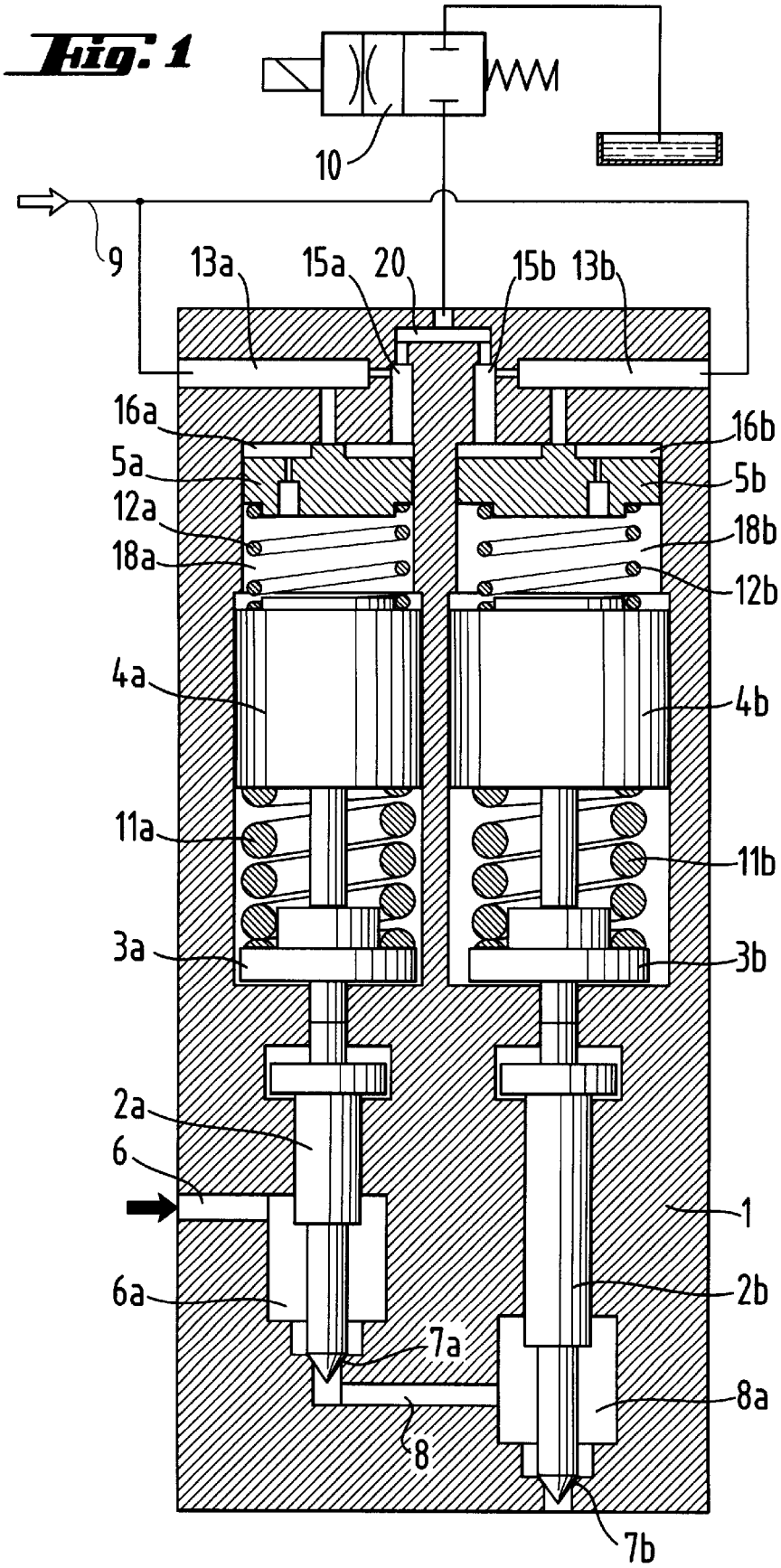
FIG. 1 shows diagrammatically a fuel injection valve arrangement according to the invention as a sectional view and at its closed initial position.
Figure 2:
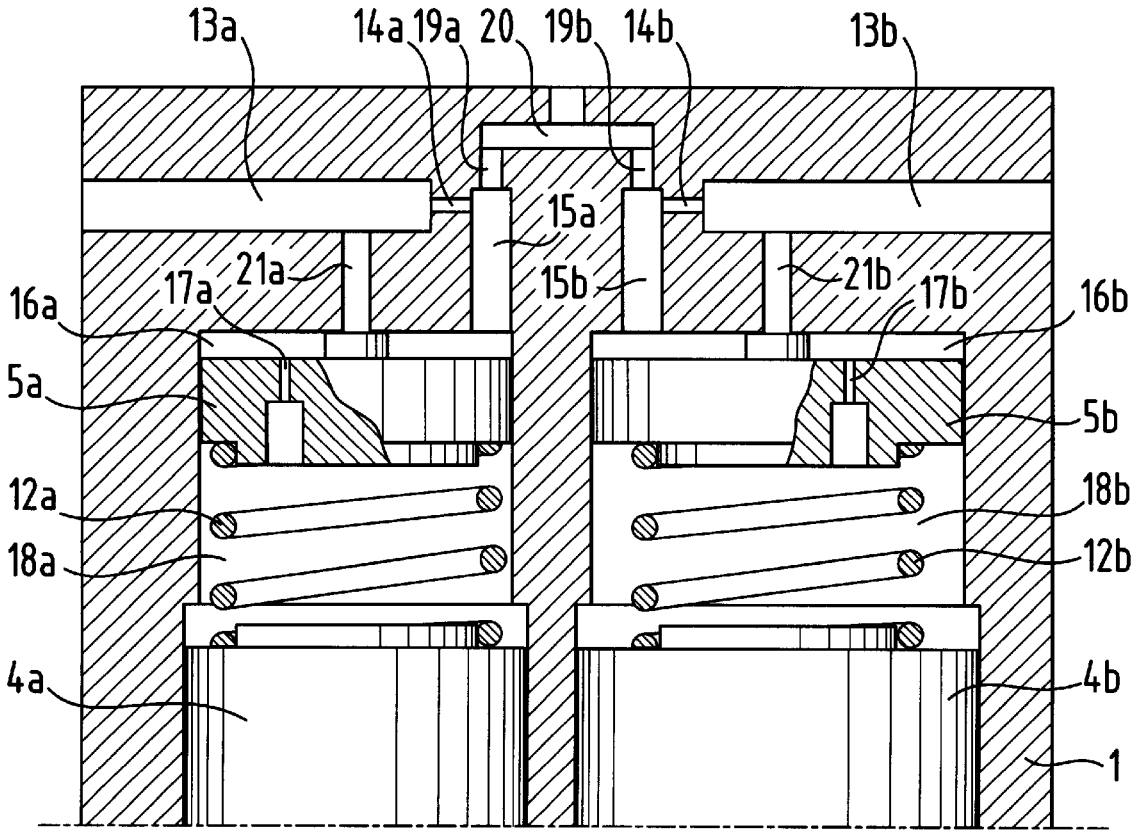
FIG. 2 shows an enlarged view of the upper section of the valve body of the fuel injection valve arrangement shown in FIG. 1, and FIGS. 3–6 show the valve arrangement of FIG. 1 at different operation positions.

In the drawing, the reference 1 designates a valve body in which there are two separate needle valve units, which are operationally arranged in series. A first needle valve unit includes a first valve needle 2*a* and is connected via a channel 6 to a supply of fuel under pressure, preferably to a common rail, which has been indicated by an arrow. The needle valve 2*a* controls the feeding of fuel from a chamber 6*a* over a first valve sealing surface 7*a,* along a connecting channel 8, to a chamber 8*a,* from which a second valve needle 2*b* of a second needle valve unit controls the feeding of fuel over a second valve sealing surface 7*b* to a cylinder of the engine (not shown).

The first needle valve further comprises a control element 3*a,* a piston device 4*a,* and an auxiliary piston 5*a* , which are operationally connected with each other. There is a compression spring 11*a* between the control element 3*a* and the piston device 4*a,* against the force of which elements 3*a* and 4*a* may move. Similarly, there is a compression spring 12*a* between the piston device 4*a* and the auxiliary piston 5*a.* The construction of the second needle valve unit corresponds to that of the first needle valve unit; it comprises a valve needle 2*b,* control element 3*b,* piston device 4*b,* auxiliary piston 5*b* and springs 11*b* and 12*b.*

The control of the needle valves is accomplished by a hydraulic oil circuit 9, which provides a basic control pressure for the needle valve units, and by a solenoid valve 10, with the assistance of which the opening and closing of the needle valve units are accomplished through various chambers and constriction channels by utilizing pressure differences. Timing differences between the needle valves are effected by dimensioning factors, as will be later described in more detailed manner.

The hydraulic oil circuit 9 acts directly on chambers 13*a* and 13*b,* which are connected through constriction channels 14*a* and 14*b* to chambers 15*a* and 15*b.* In this manner the pressure of the hydraulic oil is communicated to chambers 16*a* and 16*b* and thus acts on auxiliary pistons 5*a* and 5*b.* In addition, the chamber 16*a* is connected through a constriction channel 17*a* to a chamber 18*a* between the piston device 4*a* and the auxiliary piston 5*a* and, similarly the chamber 16*b* is connected through a constriction channel 17*b* to a chamber 18*b* between the piston device 4*b* and the auxiliary piston 5*b.* Further, the chambers 15*a* and 15*b* are connected to a chamber 20 through constriction channels 19*a* and 19*b,* which chamber 20 is connected to the solenoid valve 10. The chambers 13*a* and 13*b* are connected to channels 21*a* and 21*b* respectively. The channels 21*a* and 21*b* are blocked by the auxiliary pistons 5*a* and 5*b* when they are in their uppermost positions, but otherwise the channels 21*a* and 21*b* debouch into the chambers 16*a* and 16*b* respectively.

Figure 3:
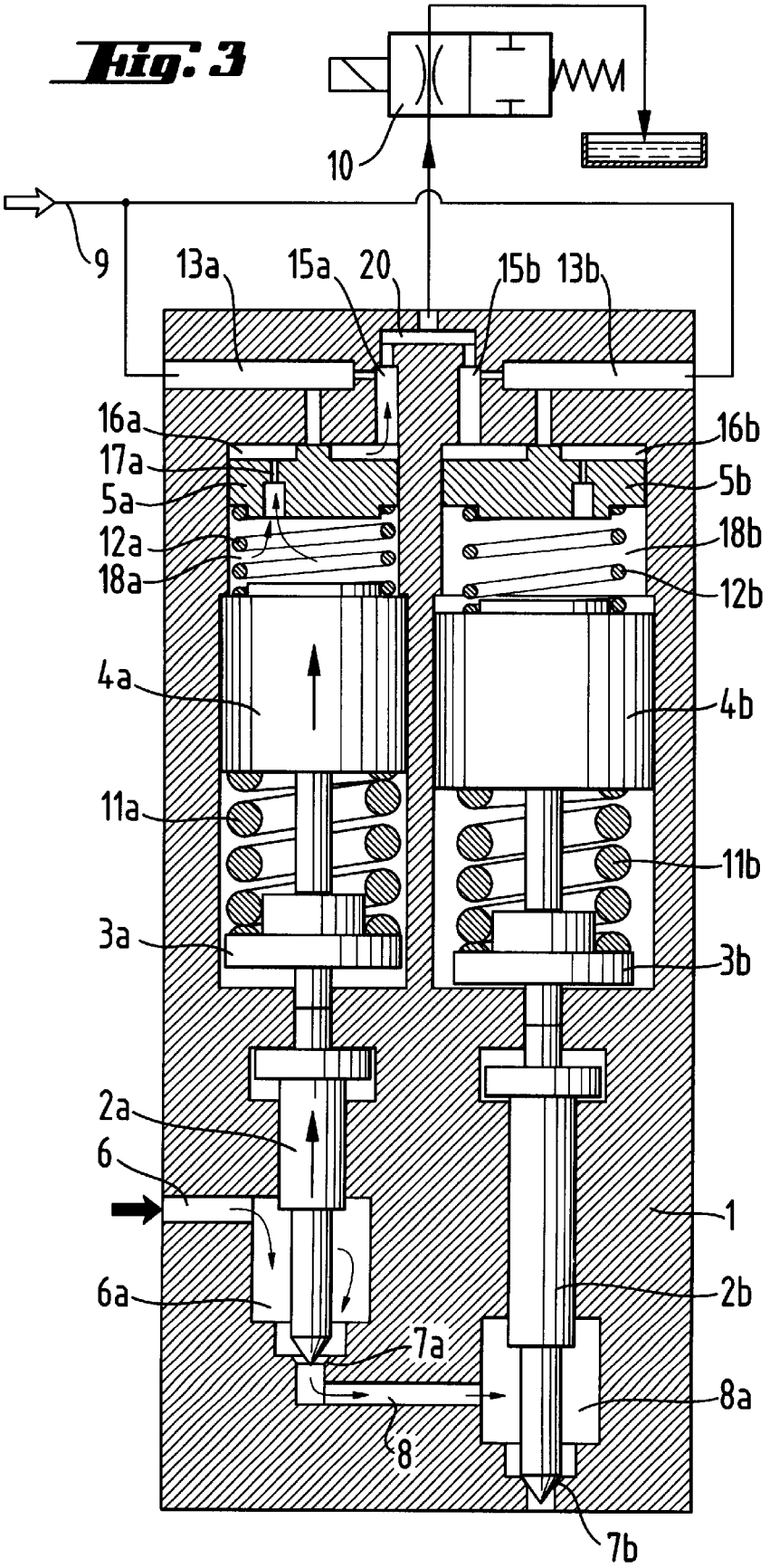

The operation of the needle valves is as follows. In the situation shown in FIG. 1, where the solenoid valve 10 is closed, the pressure of the hydraulic oil in the circuit 9 acts on all the chambers and channels connected with the hydraulic oil system. The pressure in the chambers 18*a* and 18*b,* aided by the springs 12*a* and 12*b,* forces the auxiliary pistons to their uppermost positions, blocking the channels 21*a* and 21*b,* and forces the piston devices 4*a* and 4*b* downwards and urges the valve needles 2*a* and 2*b* to the closed positions. When the solenoid valve 10 is opened (FIG. 3), the chamber 20 is connected through the valve 10 to substantially lower pressure, for example to atmospheric pressure. Then the pressure in the chamber 20 decreases rapidly. Because the constriction channel 19*a* is of greater diameter than the constriction channel 14*a* and similarly the constriction channel 19*b* is of greater diameter than the constriction channel 14*b,* the pressure decreases rapidly also in chambers 15*a,* 16*a* and also in chambers 15*b* and 16*b,* allowing hydraulic oil to flow from the chambers 18*a* and 18*b* through the constriction channels 17*a* and 17*b.*

The feed pressure of the fuel in the chamber 6*a* tends to lift the valve needle 2*a* and, and on the other hand the pressure of the fuel remaining in the chamber 8*a* tends to lift the valve needle 2*b.* The velocity at which the valve needles 2*a* and 2*b* rise depends on how fast the oil in the chambers 18*a* and 18*b* is able to flow through the constriction channels 17*a* and 17*b,* allowing upward movement of the piston devices 4*a* and 4*b.* Because, according to the invention, the first needle valve is to be opened first, the diameter or cross sectional area of the piston device 4*a* is selected to be smaller than the diameter of the piston device 4*b.* Consequently, in the event that the diameters of the constriction channels 17*a* and 17*b* correspond to each other, the piston device 4*a* moves faster upwards in the figure and the first needle valve opens first. The situation corresponds to that shown in FIG. 3.

Figure 4:
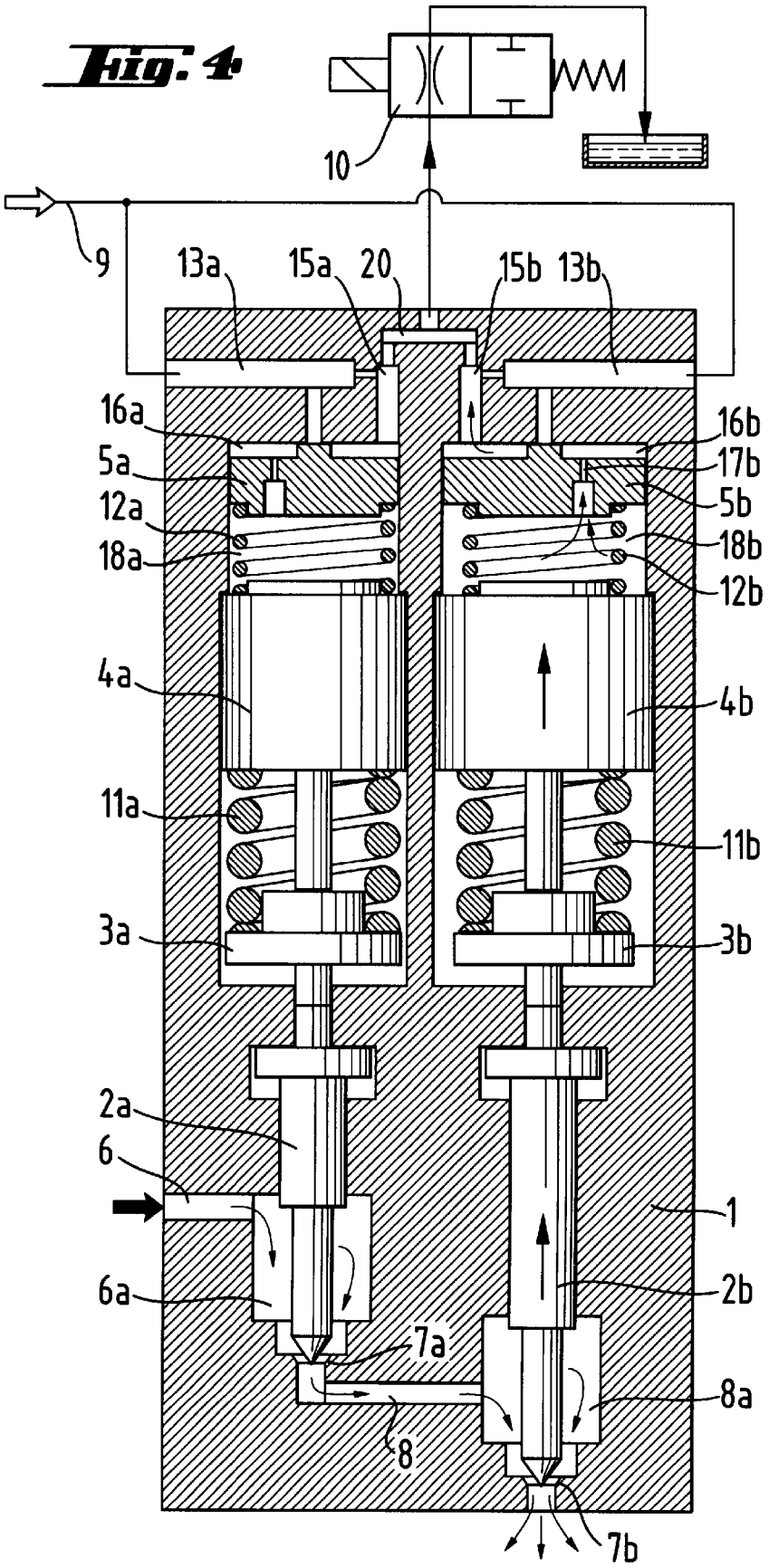

Similarly, flow of oil from the chamber 18*b* through the constriction channel 17*b* to the chamber 16*b* allows upward movement of the piston device 4*b,* and thereby opening the second needle valve. Because both of the needle valves are then open, the injection of the fuel takes place from the common rail past the sealing surfaces 7*a* and 7*b* of the valves into cylinder of the engine. The situation corresponds to that shown in FIG. 4.

Figure 5:
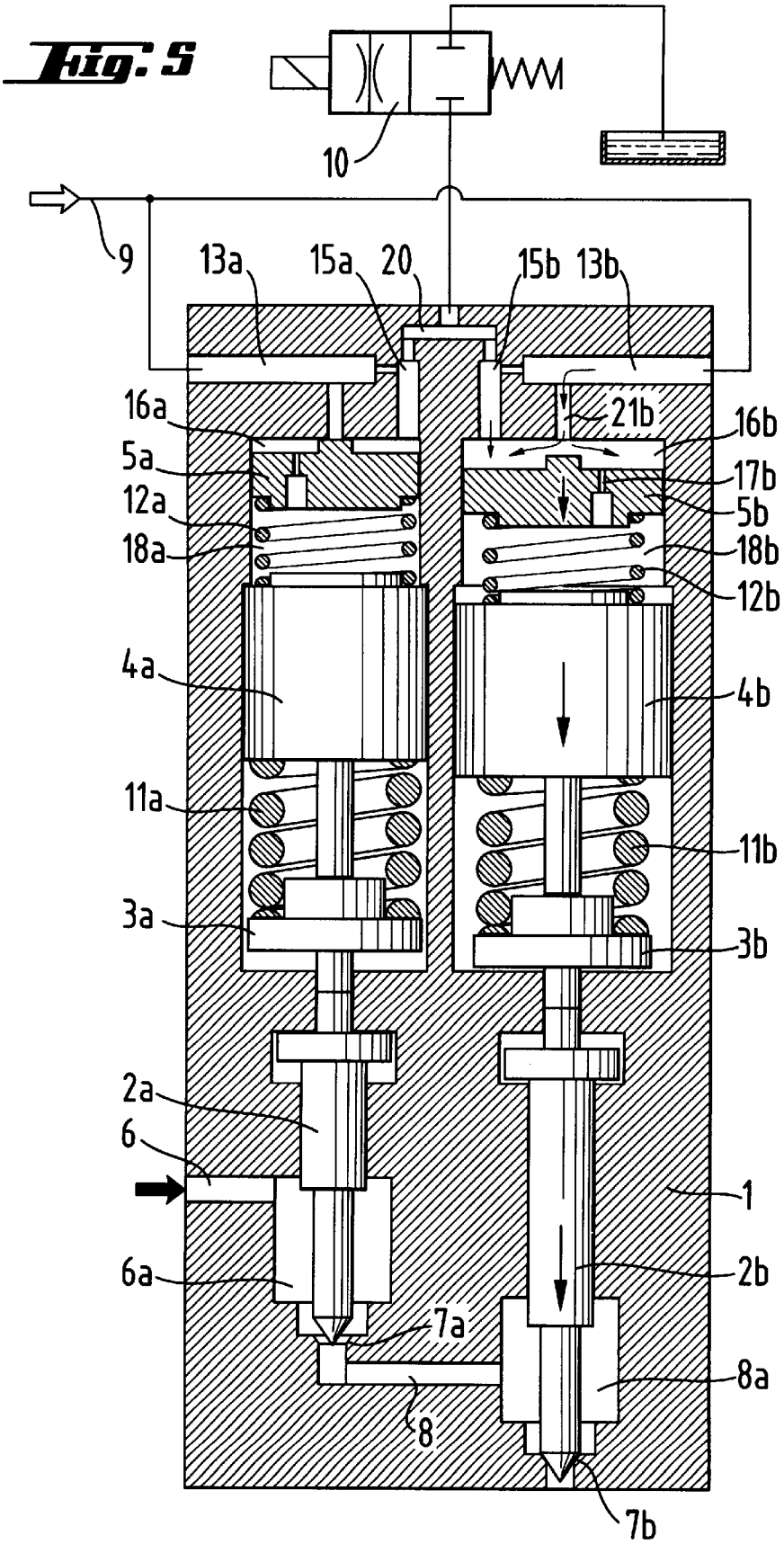
Figure 6:
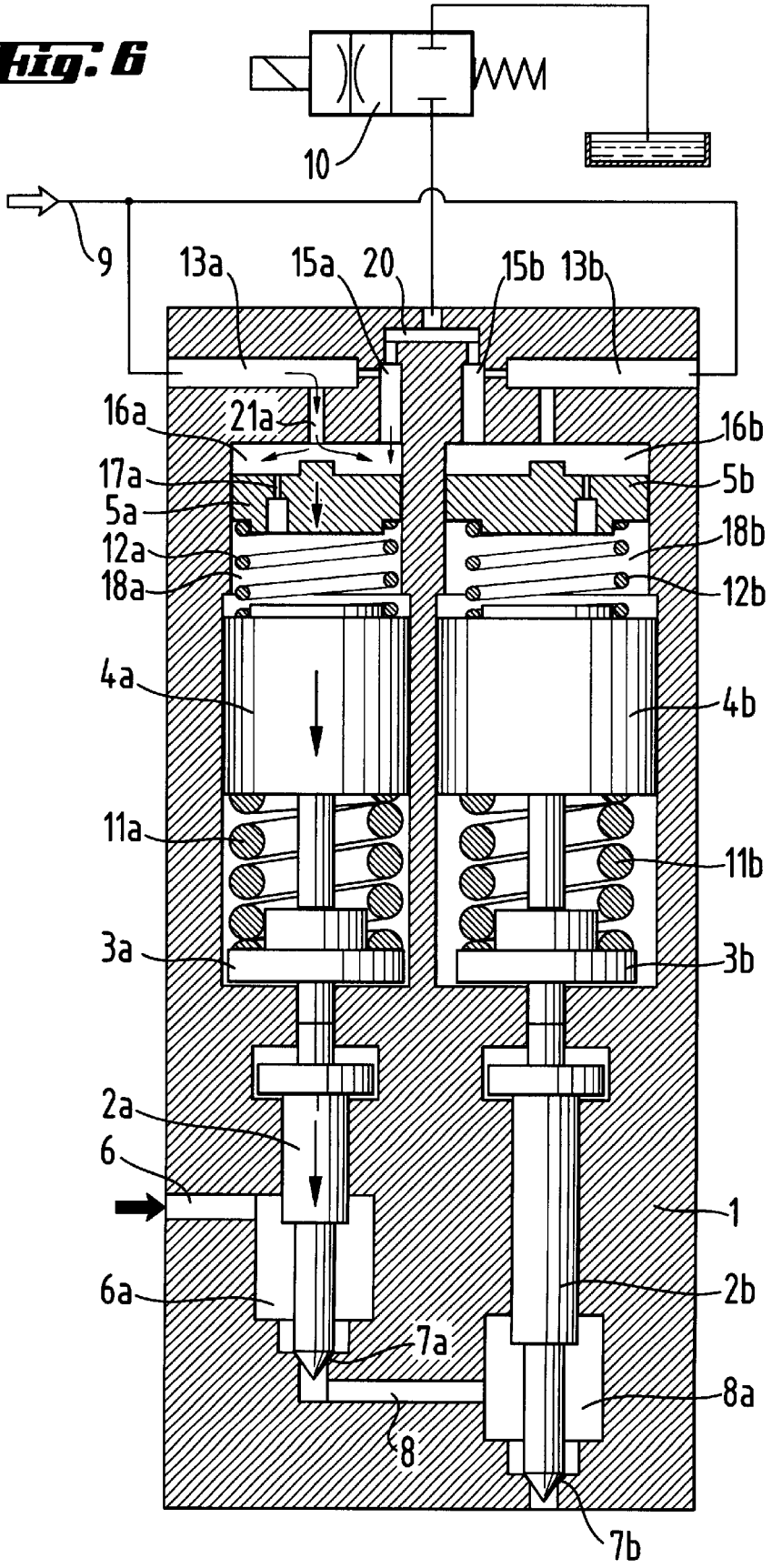

FIGS. 5 and 6 show the situation upon closing of the needle valves. When the solenoid valve 10 closes and the connection of the chamber 20, and thereby also of the other chambers, to lower pressure is cut off, the pressure in the chambers 20, 15*a* and 15*b,* and 16*a* and 16*b,* begins to rise. Thus the pressure in the chamber 16*a* is greater than that in the chamber 18*a* and the pressure in the chamber 16*b* is greater than that in the chamber 18*b.* As a result of this the auxiliary pistons 5*a* and 5*b* start moving downwards and simultaneously the constriction channels 21*a* and 21*b* open. Because the constriction channel 21*b* is selected to be of greater diameter than the constriction channel 21*a,* the pressure applied to the auxiliary piston 5*b* increases faster and therefore the second needle valve closes first, whereupon the injection of fuel ends, of the situation in FIG. 5. By virtue of the constriction channels 19*a* and 19*b,* this greater pressure communicated through the constriction channel 21*b* is not communicated to the chamber 16*a* and does not act on the auxiliary piston 5*a.* Thus the downward movement of the auxiliary piston 5*a* and thereby closing of the first needle valve are mainly dependent on the increased pressure being communicated through the constriction channel 21*a.* When the pressure has risen enough, the first needle valve closes. The situation corresponds to that shown in FIG. 6.

After that, the pressure in the hydraulic oil circuit 9 is communicated to the chambers 18*a* and 18*b* through the constriction channels 17*a* and 17*b,* whereupon the increasing pressure and the force of the springs 12*a* and 12*b* move the auxiliary pistons 5*a* and 5*b* back to the initial position shown in FIG. 1 and the constriction channels 21*a* and 21*b* close again.

In the described embodiment the diameters of the constriction channels 14*a* and 14*b* are equal and the same applies also to the diameters of the constriction channels 19*a* and 19*b* and to the diameters of the constriction channels 17*a* and 17*b,* and control in relative timing of the opening and closing of the needle valves is achieved through difference in diameter of the piston device 4*a* relative to the piston device 4*b* and difference in diameter of the constriction channel 21*a* relative to the constriction channel 21*b.* Alternatively, if the constriction channel 17*a* were of greater diameter then the constriction channel 17*b,* it would be possible to ensure that the first needle valve opens before the second needle valve even if the diameters of the piston devices 4*a* and 4*b* were equal. Accordingly it is possible to alter a respective diameter and precise position of channels to ensure that the first needle valve opens first and closes last, which is advantageous for the operation of the system.

The described structure operates so that the needle valves may open, if the pressure in the hydraulic oil system goes down. For this reason it is advantageous to provide the common rail used for fuel injection with a safety device which quickly depressurizes the common rail if the pressure of the hydraulic oil decreases to too a low level. Such a safety device is shown in U.S. patent application Ser. No. 09/323,729.

The hydraulic oil circuit may advantageously be for example a part of the lubrication oil circuit of the engine, as long as the pressure of the lubrication oil is increased, for example by a booster pump, to a suitable level for controlling the valves, or about 200 bar. The solution according to the invention is advantageous in the event that heavy oil is used as the fuel to be injected. In the illustrated embodiment each needle valve comprises several discrete parts operationally connected with each other. This construction is advantageous with respect to manufacture and assembly. However, other types of alternative constructions are also possible. For example the valve needles 2*a* and 2*b* may be attached to the control elements 3*a* and 3*b* if so desired.

In normal operation, the piston device 4 and the control element 3 of each needle valve move together as a unit unless the pressure of the fuel rail and the pressure of the hydraulic oil circuit fall, in which case the spring 11 pushes the element 3 away from the piston device 4 and the needle valve closes. This feature ensures that the needle valves are closed when the system is not activated for use. For example, before starting the engine the pressure in the common rail is low and there is no pressure in the hydraulic oil circuit 9; and the action of the springs 11 closes the needle valves and prevents entry of fuel into the cylinder.

The invention is not restricted to the embodiment shown, but several modifications are feasible within the scope of the attached claims.

What is claimed is:

1. An injection valve arrangement for a combustion engine having a fuel feeding system with a common rail, the injection valve arrangement including:

a valve body having a fuel inlet for connection to the common rail of the fuel feeding system and a control inlet for connection to a control pressure, and the valve body also having a fuel outlet, a first needle valve inside the valve body, the first needle valve including a first valve needle, a first piston arrangement cooperating with the first valve needle for controlling operation of the first needle valve, the first piston arrangement comprising a main piston device which bounds a coupling pressure chamber, the main piston device being between the first valve needle and the coupling pressure chamber, so that pressure in the coupling pressure chamber acting on the main piston device resists opening movement of the first valve needle, and wherein the coupling pressure chamber is connected to the control inlet through a constriction channel, a second needle valve inside the valve body, the second needle valve including a second valve needle, a second piston arrangement cooperating with the second valve needle for controlling operation of the second needle valve, and wherein the first and second needle valves are arranged operationally in series with the first needle valve connected to the fuel inlet of the valve body for controlling supply of fuel to the second needle valve and the second needle valve connected to the fuel outlet of the valve body for controlling injection of fuel into a cylinder of the engine, and wherein the first needle valve is arranged to open before the second needle valve during a fuel injection cycle by coordinated action of the first and second piston arrangements.

2. An injection valve arrangement according to claim 1, wherein the first needle valve closes after the second needle valve during a fuel injection cycle.

3. An injection valve arrangement according to claim 1, wherein the first piston arrangement further comprises an auxiliary piston and the coupling pressure chamber is defined between the main piston device and the auxiliary piston.

4. An injection valve arrangement according to claim 3, wherein the auxiliary piston is spring loaded in direction away from the main piston device.

5. An injection valve arrangement according to claim 3, wherein the auxiliary piston is located between the coupling pressure chamber and a control pressure chamber and said constriction channel is formed in the auxiliary piston and opens into both the coupling pressure chamber and the control pressure chamber.

6. An injection valve arrangement according to claim 5, wherein the control pressure chamber is connected to the control inlet through a second constriction channel and is additionally connectable to the control inlet through a further constriction channel, and wherein the auxiliary piston is movable to a position in which it blocks the further constriction channel and is movable away from said position to open the further constriction channel for closing the first needle valve.

7. An injection valve arrangement for a combustion engine having a fuel feeding system with a common rail, the injection valve arrangement including:

a valve body formed with a control pressure chamber and having a fuel inlet for connection to the common rail of the fuel feeding system and also having a fuel outlet, a first needle valve inside the valve body, the first needle valve including a first valve needle, a first piston arrangement bounding the control pressure chamber and cooperating with the first valve needle for controlling operation of the first needle valve, a second needle valve inside the valve body, the second needle valve including a second valve needle, a second piston arrangement cooperating with the second valve needle for controlling operation of the second needle valve, and wherein the first and second needle valves are arranged operationally in series with the first needle valve connected to the fuel inlet of the valve body for controlling supply of fuel to the second needle valve and the second needle valve connected to the fuel outlet of the valve body for controlling injection of fuel into a cylinder of the engine, and wherein the first needle valve is arranged to open before the second needle valve during a fuel injection cycle by coordinated action of the first and second piston arrangements, and the arrangement further comprises a means for supplying hydraulic oil under pressure to the control pressure chamber and a control valve for selectively connecting the control pressure chamber to a space at a substantially lower pressure than the supply pressure of the hydraulic oil.

8. An injection valve arrangement for a combustion engine having a fuel feeding system with a common rail, the injection valve arrangement including:

a valve body having a fuel inlet for connection to the common rail of the fuel feeding system and a control inlet for connection to a control pressure, the valve body also having a fuel outlet, a first needle valve inside the valve body, the first needle valve including a first valve needle, a first piston arrangement cooperating with the first valve needle for controlling operation of the first needle valve, a second needle valve inside the valve body, the second needle valve including a second valve needle, a second piston arrangement cooperating with the second valve needle for controlling operation of the second needle valve, the second piston arrangement comprising a main piston device which bounds a coupling pressure chamber, the main piston device being between the second valve needle and the coupling pressure chamber, so that pressure in the coupling pressure chamber acting on the main piston device resists opening movement of the second valve needle, and wherein the coupling pressure chamber is connected to the control inlet through a constriction channel, and wherein the first and second needle valves are arranged operationally in series with the first needle valve connected to the fuel inlet of the valve body for controlling supply of fuel to the second needle valve and the second needle valve connected to the fuel outlet of the valve body for controlling injection of fuel into a cylinder of the engine, and wherein the first needle valve is arranged to open before the second needle valve during a fuel injection cycle by coordinated action of the first and second piston arrangements.

9. An injection valve arrangement according to claim 8, wherein the second piston arrangement further comprises an auxiliary piston and the coupling pressure chamber is defined between the main piston device and the auxiliary piston.

10. An injection valve arrangement according to claim 9, wherein the auxiliary piston is spring loaded in direction away from the main piston device.

11. An injection valve arrangement according to claim 9, wherein the auxiliary piston is located between the coupling pressure chamber and a control pressure chamber and said constriction channel is formed in the auxiliary piston and opens into both the coupling pressure chamber and the control pressure chamber.

12. An injection valve arrangement according to claim 11, wherein the control pressure chamber is connected to the control inlet through a second constriction channel and is additionally connectable to the control inlet through a further constriction channel, and wherein the auxiliary piston is movable to a position in which it blocks the further constriction channel and is movable away from said position to open the further constriction channel for closing the first needle valve.

13. An injection valve arrangement for a combustion engine having a fuel feeding system with a common rail, the injection valve arrangement including:

a valve body formed with a control pressure chamber and having a fuel inlet for connection to the common rail of the fuel feeding system and also having a fuel outlet, a first needle valve inside the valve body, the first needle valve including a first valve needle, a first piston arrangement cooperating with the first valve needle for controlling operation of the first needle valve, a second needle valve inside the valve body, the second needle valve including a second valve needle, a second piston arrangement bounding the control chamber and cooperating with the second valve needle for controlling operation of the second needle valve, and wherein the first and second needle valves are arranged operationally in series with the first needle valve connected to the fuel inlet of the valve body for controlling supply of fuel to the second needle valve and the second needle valve connected to the fuel outlet of the valve body for controlling injection of fuel into a cylinder of the engine, and wherein the first needle valve is arranged to open before the second needle valve during a fuel injection cycle by coordinated action of the first and second piston arrangements, and the arrangement further comprises a means for supplying hydraulic oil under pressure to the control pressure chamber and a control valve for selectively connecting the control pressure chamber to a space at a substantially lower pressure than the supply pressure of the hydraulic oil.

14. An injection valve arrangement for a combustion engine having a fuel feeding system with a common rail, the injection valve arrangement including:

a valve body having a fuel inlet for connection to the common rail of the fuel feeding system and a control inlet for connection to a control pressure, a first needle valve inside the valve body, the first needle valve including a first valve needle, a first piston arrangement cooperating with the first valve needle for controlling operation of the first needle valve and comprising a main piston device and an auxiliary piston, the main piston device being between the first valve needle and the auxiliary piston and there being a first pressure chamber between the main piston device and the auxiliary piston, whereby pressure in the first pressure chamber acting on the main piston device of the first piston arrangement resists opening movement of the first valve needle, and wherein the first pressure chamber is connected to the control inlet through a first constriction channel, a second needle valve inside the valve body, the second needle valve including a second valve needle, a second piston arrangement cooperating with the second valve needle for controlling operation of the second needle valve, and comprising a main piston device and an auxiliary piston, the main piston device of the second piston arrangement being between the second valve needle and the auxiliary piston of the second piston arrangement and there being a second pressure chamber between the main piston device and the auxiliary piston of the second piston arrangement, whereby pressure in the second pressure chamber acting on the main piston device of the second piston arrangement resists opening movement of the second valve needle, and wherein the second pressure chamber is connected to the control inlet through a second constriction channel, and wherein the first and second needle valves are arranged operationally in series with the first needle valve connected to the fuel inlet of the valve body for controlling supply of fuel to the second needle valve and the second needle valve connected to the fuel outlet of the valve body for controlling injection of fuel into a cylinder of the engine, and wherein the first needle valve is arranged to open before the second needle valve during a fuel injection cycle by coordinated action of the first and second piston arrangements.

15. An injection valve arrangement according to claim 14, wherein the main piston device of the first piston arrangement is of smaller diameter than the main piston device of the second piston arrangement.

16. An injection valve arrangement according to claim 14, wherein the auxiliary pistons of the first and second piston arrangements are spring loaded in direction away from the respective main piston devices.

17. An injection valve arrangement for a combustion engine having a fuel feeding system with a common rail, the injection valve arrangement including:

a valve body having a fuel inlet for connection to the common rail of the fuel feeding system and also having a fuel outlet, wherein the valve body is formed with first and second control pressure chambers and has a control inlet for connection to a control pressure, the first and second control pressure chambers are connected to the control inlet by first and second main constriction channels respectively, the first and second control pressure chambers are connectable to the control inlet through first and second further constriction channels respectively, a first needle valve inside the valve body, the first needle valve including a first valve needle, a first piston arrangement bounding the first control pressure chamber and cooperating with the first valve needle for controlling operation of the first needle valve, the first piston arrangement being movable to a position in which it blocks the first further constriction channel and being movable away from said position to open the first further constriction channel for closing the first needle valve, a second needle valve inside the valve body, the second needle valve including a second valve needle, a second piston arrangement bounding the second control pressure chamber and cooperating with the second valve needle for controlling operation of the second needle valve, the second piston arrangement being movable to a position in which it blocks the second further constriction channel and being movable away from said position to open the second further constriction channel for closing the second needle valve, and wherein the first and second needle valves are arranged operationally in series with the first needle valve connected to the fuel inlet of the valve body for controlling supply of fuel to the second needle valve and the second needle valve connected to the fuel outlet of the valve body for controlling injection of fuel into a cylinder of the engine, and wherein the first needle valve is arranged to open before the second needle valve during a fuel injection cycle by coordinated action of the first and second piston arrangements.

18. An injection valve arrangement according to claim 17, wherein the first further constriction channel is of smaller cross-sectional area than the second further constriction channel.

19. An injection valve arrangement for a combustion engine having a fuel feeding system with a common rail, the injection valve arrangement including:

a valve body having a fuel inlet for connection to the common rail of the fuel feeding system, a hydraulic inlet for connection to a source of hydraulic oil under pressure, and a fuel outlet, the valve body being formed with first and second control pressure chambers, a first needle valve inside the valve body, the first needle valve including a first valve needle, a first piston arrangement bounding the first control pressure chamber and cooperating with the first valve needle for controlling operation of the first needle valve, a second needle valve inside the valve body, the second needle valve including a second valve needle, a second piston arrangement bounding the second control pressure chamber and cooperating with the second valve needle for controlling operation of the second needle valve, and wherein the first and second needle valves are arranged operationally in series with the first needle valve connected to the fuel inlet of the valve body for controlling supply of fuel to the second needle valve and the second needle valve connected to the fuel outlet of the valve body for controlling injection of fuel into a cylinder of the engine, and wherein the first needle valve is arranged to open before the second needle valve during a fuel injection cycle by coordinated action of the first and second piston arrangements, and the first and second control pressure chambers are connected to the control inlet, whereby the first and second piston arrangements are influenced by pressure at the control inlet, and the arrangement further comprises a control valve for selectively connecting the first and second control pressure chambers to a space at a substantially lower pressure than the pressure at the control inlet.

20. An injection valve arrangement according to claim 19, wherein the control inlet is connected to the first and second control pressure chambers by first and second constriction channels respectively.

21. An injection valve arrangement according to claim 19, wherein said control valve is a solenoid valve.

* * * * *